US005706522A

United States Patent [19]

Ballarino et al.

[11] Patent Number: 5,706,522

[45] Date of Patent: Jan. 13, 1998

[54] SILICONIZED LEATHER GLOVE

[76] Inventors: Joe Ballarino; Deborah E. Ballarino, both of 488 Rouge Hills Drive, Scarborough, Ontario, Canada, M1C 2Z7

[21] Appl. No.: 736,131

[22] Filed: Oct. 24, 1996

[51] Int. Cl.[6] ..... A41D 19/00

[52] U.S. Cl. ..... 2/161.6; 2/163; 2/167; 2/169

[58] Field of Search ..... 2/158, 159, 160, 2/161.1, 161.2, 161.3, 161.4, 161.5, 161.6, 161.7, 161.8, 161.9, 162, 163, 164, 166, 167, 168, 169, 170

[56] References Cited

U.S. PATENT DOCUMENTS

| | | | |
|---|---|---|---|
| 321,497 | 7/1885 | Helfaer | 2/158 |
| 1,542,199 | 6/1925 | White | 2/161.6 |
| 1,791,581 | 2/1931 | Stokes | 2/159 X |
| 2,060,343 | 11/1936 | Palicki | 2/167 X |
| 2,210,484 | 8/1940 | Gillian | 2/159 |
| 2,217,377 | 10/1940 | Moore | 2/161.6 |
| 2,285,538 | 6/1942 | Simon | 2/164 |
| 2,459,985 | 1/1949 | Woodbury | 2/161.6 |
| 4,598,429 | 7/1986 | Mulvaney | 2/169 |
| 4,689,832 | 9/1987 | Mulvaney | 2/161.1 X |
| 5,117,509 | 6/1992 | Bowers | 2/161.1 |

*Primary Examiner*—C. D. Crowder
*Assistant Examiner*—Shirra L. Jenkins

[57] ABSTRACT

A new Siliconized Leather Glove for offering an improved work glove that is light weight and flexible while having a superior grip as well as good insulation, water-resistant, and chemical-resistant properties. A work glove formed of heavy weight canvas and split leather wherein the entire glove is coated on its exterior with a layer of silicone rubber. The glove comprises a palm piece, a back piece, and a thumb stall joined together to fit a human hand. The palm piece comprising a palm portion and the palm side of finger stalls, and the thumb stall are formed of a split leather. The back piece comprising a back portion and the back side of finger stalls is formed of a heavy weight canvas. The split leather of the palm piece and the thumb stall is coated with a layer of silicone rubber only on its outer surface. However, the heavy weight canvas of the back piece is saturated and coated throughout with a layer of silicone rubber.

7 Claims, 3 Drawing Sheets

SILICONIZED LEATHER GLOVE

BACKGROUND OF THE INVENTION

1. Field of the Invention

The present invention relates to work gloves and more particularly pertains to a new Siliconized Leather Glove for offering an improved work glove that is light weight and flexible while having a superior grip as well as good insulation, water-resistant, and chemical-resistant properties.

2. Description of the Prior Art

The use of work gloves is known in the prior art. More specifically, work gloves heretofore devised and utilized are known to consist basically of familiar, expected and obvious structural configurations, notwithstanding the myriad of designs encompassed by the crowded prior art which have been developed for the fulfillment of countless objectives and requirements.

Known prior art work gloves and silicone compositions include U.S. Pat. No. 5,260,400; U.S. Pat. No. 5,057,377; U.S. Pat. No. 5,359,735; U.S. Pat. No. 3,969,254; U.S. Pat. No. 4,850,838 and U.S. Pat. No. 5,117,509.

While these devices fulfill their respective, particular objectives and requirements, the aforementioned patents do not disclose a new Siliconized Leather Glove. The inventive device includes a work glove formed of heavy weight canvas and split leather wherein the entire glove is coated on its exterior with a layer of silicone rubber.

In these respects, the Siliconized Leather Glove according to the present invention substantially departs from the conventional concepts and designs of the prior art, and in so doing provides an apparatus primarily developed for the purpose of offering an improved work glove that is light weight and flexible while having a superior grip as well as good insulation, water-resistant, and chemical-resistant properties.

SUMMARY OF THE INVENTION

In view of the foregoing disadvantages inherent in the known types of work gloves now present in the prior art, the present invention provides a new Siliconized Leather Glove construction wherein the same can be utilized for offering an improved work glove that is light weight and flexible while having a superior grip as well as good insulation, water-resistant, and chemical-resistant properties.

The general purpose of the present invention, which will be described subsequently in greater detail, is to provide a new Siliconized Leather Glove apparatus and method which has many of the advantages of the work gloves mentioned heretofore and many novel features that result in a new Siliconized Leather Glove which is not anticipated, rendered obvious, suggested, or even implied by any of the prior art work gloves, either alone or in any combination thereof.

To attain this, the present invention generally comprises a work glove formed of heavy weight canvas and split leather wherein the entire glove is coated on its exterior with a layer of silicone rubber.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Siliconized Leather Glove apparatus and method which has many of the advantages of the work gloves mentioned heretofore and many novel features that result in a new Siliconized Leather Glove which is not anticipated, rendered obvious, suggested, or even implied by any of the prior art work gloves, either alone or in any combination thereof.

It is another object of the present invention to provide a new Siliconized Leather Glove which may be easily and efficiently manufactured and marketed.

It is a further object of the present invention to provide a new Siliconized Leather Glove which is of a durable and reliable construction.

An even further object of the present invention is to provide a new Siliconized Leather Glove which is susceptible of a low cost of manufacture with regard to both materials and labor, and which accordingly is then susceptible of low prices of sale to the consuming public, thereby making such Siliconized Leather Glove economically available to the buying public.

Still yet another object of the present invention is to provide a new Siliconized Leather Glove which provides in the apparatuses and methods of the prior art some of the advantages thereof, while simultaneously overcoming some of the disadvantages normally associated therewith.

Still another object of the present invention is to provide a new Siliconized Leather Glove for offering an improved work glove that is light weight and flexible while having a superior grip as well as good insulation, water-resistant, and chemical-resistant properties.

Yet another object of the present invention is to provide a new Siliconized Leather Glove which includes a work glove formed of heavy weight canvas and split leather wherein the entire glove is coated on its exterior with a layer of silicone rubber.

Still yet another object of the present invention is to provide a new Siliconized Leather Glove that is different from traditional work gloves in that it would be coated on its exterior with a layer of silicone rubber.

Even still another object of the present invention is to provide a new Siliconized Leather Glove that enables its user to more easily grip and hold onto various objects.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
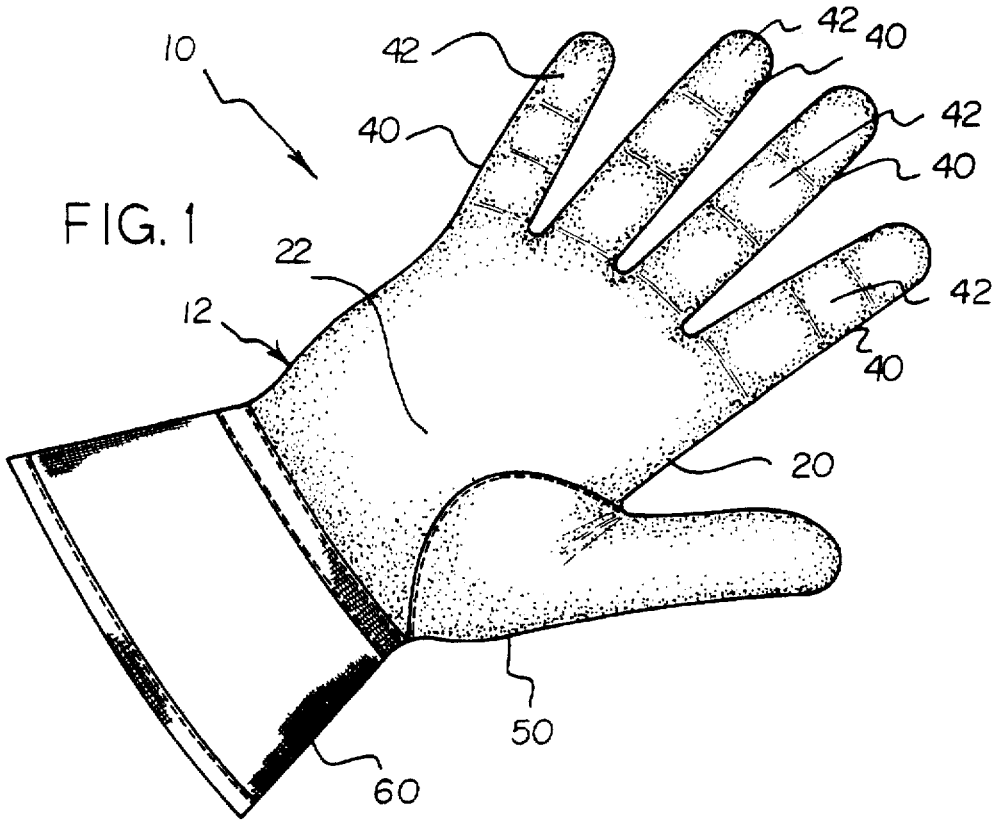
FIG. 1 is a palm view of a new Siliconized Leather Glove according to the present invention.

With reference now to the drawings, and in particular to FIGS. 1 through 6 thereof, a new Siliconized Leather Glove embodying the principles and concepts of the present invention and generally designated by the reference numeral 10 will be described.

Figure 2:
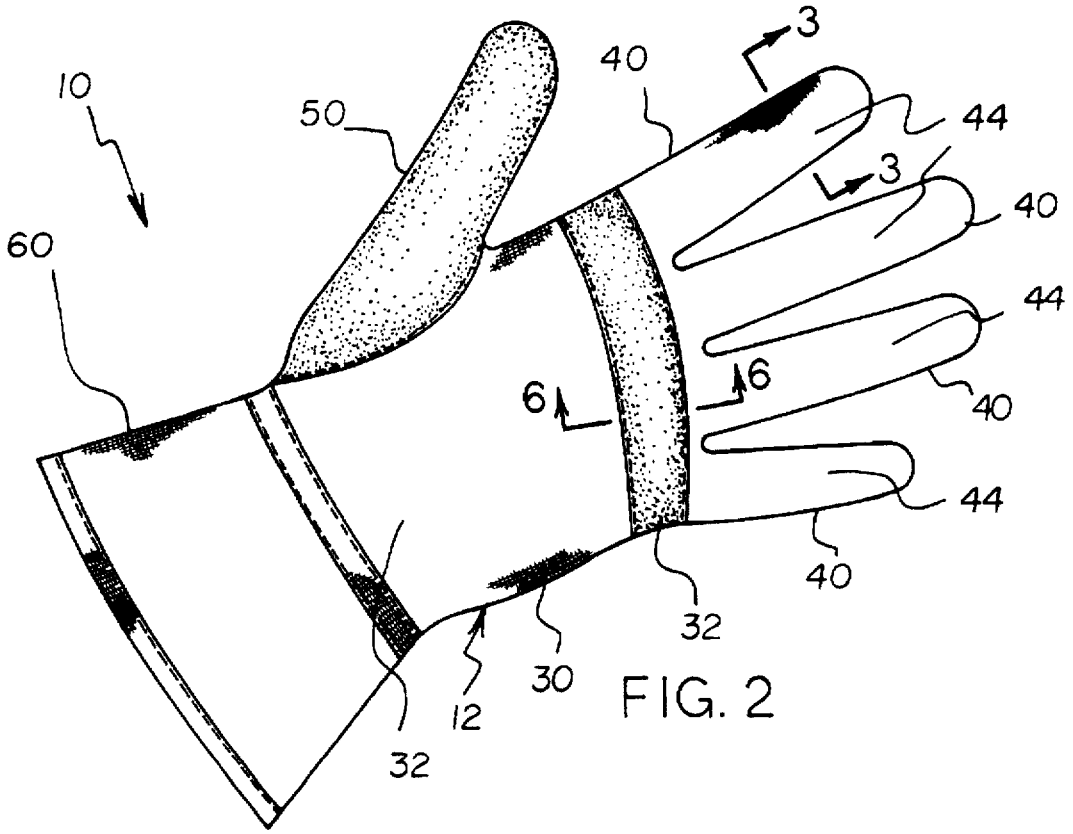
FIG. 2 is a back view of a new Siliconized Leather Glove according to the present invention.
Figure 3:
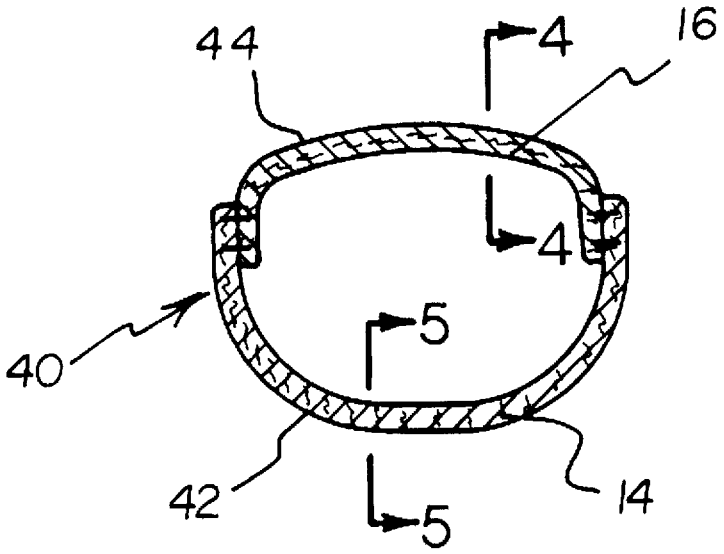
FIG. 3 is a cross sectional view taken along line 3—3 of FIG. 2.

More specifically, it will be noted that the Siliconized Leather Glove 10 comprises a work glove 12 formed of heavy weight canvas and split leather wherein the entire work glove 12 is coated on its exterior with a layer of silicone rubber 18. As best illustrated in FIGS. 1 through 3, it can be shown that the work glove 12 comprises a palm piece 20, a back piece 30, and a thumb stall 50 joined together to fit a human hand. The palm piece 20 comprises a palm portion 22 and a palm side 42 of finger stalls 40 extending from the palm portion 22. The back piece 30 comprises a back portion 32 and a back side 44 of finger stalls 40 extending from the back portion 32. The palm piece 20 comprising the palm portion 22 and the palm side 42 of the finger stalls 40, and the thumb stall 50 are formed of a split leather 14. The back piece 30 comprising the back portion 32 and the back side 44 of the finger stalls 40 is formed of a heavy weight canvas 16.

Figure 4:
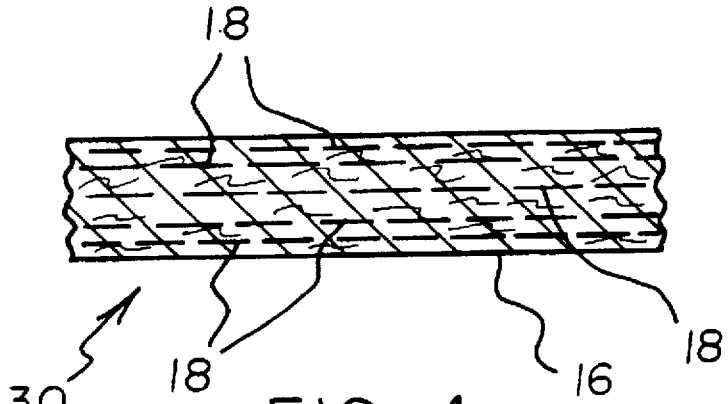
FIG. 4 is a cross sectional view taken along line 4—4 of FIG. 3.
Figure 5:
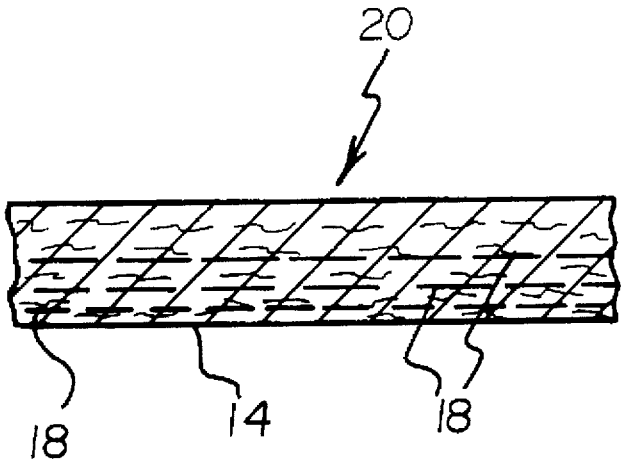
FIG. 5 is a cross sectional view taken along line 5—5 of FIG. 3.

As best illustrated in FIGS. 4 and 5, it can be shown that the split leather 14 of the palm piece 20 and the thumb stall 50 is coated with the layer of silicone rubber 18 only on an outer surface. However, the heavy weight canvas 16 of the back piece 30 is saturated and coated throughout with the layer of silicone rubber 18.

Figure 6:
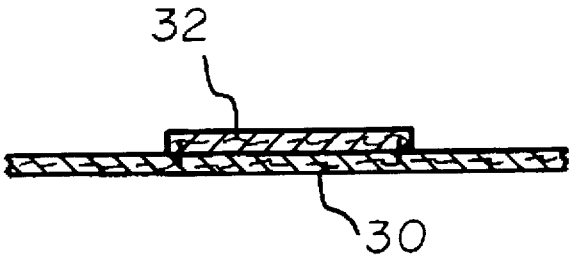
FIG. 6 is a cross sectional view taken along line 6—6 of FIG. 2.

As best illustrated in FIGS. 2 and 6, it can be shown that the back piece 30 of the work glove 12 may include a knuckle guard 32 attached to the back piece 30 near where the back side 44 of finger stalls 40 extend from the back portion 32 and along the approximate location of the knuckles of a wearer of the work glove 12. The knuckle guard 32 is formed of a split leather 14 and may also be coated with the layer of silicone rubber 18 on the outer surface.

As best illustrated in FIGS. 1 and 2, it can be shown that the work glove 12 further comprises a wrist piece 60 which is attached to and extends from the palm piece 20 and the back piece 30. The wrist piece 60 diverges from the point at which it is attached to the palm piece 20 and the back piece 30. The wrist piece 60 is formed of a heavy weight canvas 16 and may also be saturated and coated throughout with the layer of silicone rubber 18.

In use, a wearer of the work glove 12 inserts his or her thumb in the thumb stall 50 and inserts his or her fingers in the finger stalls 40. The wearer of the work glove 12 can then safely and comfortably perform the necessary tasks. The silicone rubber coatings 18 on the heavy weight canvas 16 and split leather 14 provide an improved work glove 12 that is light weight and flexible while having a superior grip as well as good insulation, water-resistant, and chemical-resistant properties.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A Siliconized Leather Glove comprising:

a glove comprising a palm piece comprising a palm portion and a palm side of finger stalls extending from said palm portion, said palm piece formed of a split leather, a back piece comprising a back portion and a back side of finger stalls extending from said back portion, said back piece formed of a heavy weight canvas, and a thumb stall, said thumb stall formed of said split leather, said palm piece, said back piece, and said thumb stall joined together to fit a human hand; and silicone rubber, said split leather of said palm piece and said thumb stall coated with said silicone rubber only on an outer surface and said heavy weight canvas of said back piece saturated and coated throughout with said silicone rubber.

2. The Siliconized Leather Glove of claim 1, wherein said glove further comprises a knuckle guard attached to said back piece where said back side of finger stalls extend from said back portion and along an approximate location of the knuckles of a wearer of said glove.

3. The Siliconized Leather Glove of claim 2, wherein said knuckle guard is formed of said split leather.

4. The Siliconized Leather Glove of claim 3, wherein said split leather of said knuckle guard is coated with said silicone rubber on said outer surface.

5. The Siliconized Leather Glove of claim 1, wherein said glove further comprises a wrist piece attached to said palm piece and said back piece, said wrist piece extending and diverging from said palm piece and said back piece.

6. The Siliconized Leather Glove of claim 5, wherein said wrist piece is formed of said heavy weight canvas.

7. The Siliconized Leather Glove of claim 6, wherein said heavy weight canvas of said wrist piece is saturated and coated throughout with said silicone rubber.

* * * * *